US006324885B1

(12) United States Patent
Klemm et al.

(10) Patent No.: US 6,324,885 B1
(45) Date of Patent: Dec. 4, 2001

(54) ORIENTING STATION HAVING A ROD-TYPE TRANSMISSION

(75) Inventors: Peter Klemm, Stuttgart; Hans Hofele; Jürgen Eltze, both of Goeppingen, all of (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/561,901

(22) Filed: May 1, 2000

(30) Foreign Application Priority Data

Apr. 29, 1999 (DE) ..... 199 19 433

(51) Int. Cl.[7] ..... B21D 43/05
(52) U.S. Cl. ..... 72/405.08
(58) Field of Search ..... 72/405.08, 405.1, 72/405.01, 405.09; 198/621.1

(56) References Cited

U.S. PATENT DOCUMENTS 4,641,515 * 2/1987 Braun ..... 72/405.08
5,875,673 * 3/1999 Brzezniak ..... 72/405.08

FOREIGN PATENT DOCUMENTS 196 05 159 * 8/1997 (DE) ..... 72/405.08
16918197 11/1997 (DE) .
29803274 7/1998 (DE) .
59-163036 * 9/1984 (JP) ..... 72/405.08
63-207430 * 8/1988 (JP) ..... 72/405.08

OTHER PUBLICATIONS

Copy of the International Search report.

* cited by examiner

*Primary Examiner*—Daniel C. Crane
(74) *Attorney, Agent, or Firm*—Crowell & Moring LLP

(57) ABSTRACT

An orienting station provided particularly for press systems has a receiving device which is carried by a rod-type transmission. This rod-type transmission is supported on drive units of a driving device. The drive units are disposed in a stationary manner. The rods of the rod-type transmission are rigid and their lengths cannot be changed.

16 Claims, 3 Drawing Sheets

ORIENTING STATION HAVING A ROD-TYPE TRANSMISSION

BACKGROUND OF THE INVENTION

This application claims priority of 19919433.5, filed on Apr. 29, 1999, the disclosure of which is expressly incorporated by reference herein.

The present invention relates to an orienting station, particularly for suction presses.

For manufacturing and machining vehicle body parts, particularly for motor vehicles, suction presses are used in practice. These are press systems which are constructed of several presses arranged in a row and optionally connected with one another. The presses are linked with one another by way of a transport system which carries out transport of the parts. In each press, a tool is arranged which continuously opens and closes. The transfer system has the task of guiding a sheet metal part situated in the tool out of this tool when the tool opens and to place a new workpiece in the tool before the tool closes again. In this case, the sheet metal parts must be placed in the tool in the correct positioning. The workpiece position (parts position) is normally not constant in all tools. This means that the orientation of the sheet metal parts during the passage through the press system may have to be changed between the individual tools. This depends on the concrete design of the sheet metal part. It may, for example, be required to swivel the sheet metal part between the individual tools about a horizontal tilting axis oriented transversely to the transport direction. Furthermore, the sheet metal part may have to be laterally displaced or otherwise reoriented.

For this purpose, a flexible multiple transfer system, which has a modular construction, is used a described in DE 19654474 A1. Transfer modules arranged between the individual presses or tools, in each case, carry out the transfer of the sheet metal parts from tool to tool. The transfer modules each have a suction bridge which is spatially guided at its ends by a steering gear. In this case, the suction bridge travels along a transfer curve. In addition, the swivelling position as well as another orientation of the suction bridge during the transfer step can be changed. The steering gear connects the suction bridge with drive units.

With large tool distances, it is frequently desirable to shorten the transfer step. For this purpose, intermediate depositing devices are arranged between the individual presses and tools. These can be used for the reorientation of the sheet metal parts. As a result, the transfer system can, in turn, be simplified. DE 1961867 A1 describes intermediate depositing devices which are constructed as orienting stations having a carrier frame with depositing devices for the sheet metal parts. The carrier frame is supported by six legs which in pairs enclose an angle with one another. The legs can each be telescoped and are provided with a servo motor. As a result of the targeted length adjustment of the legs, the position of the carrier frame can be changed and adjusted. The rods must contain the drives for the rod length adjustment as well as telescoping guides.

SUMMARY OF THE INVENTION

An object of the invention is to provide orienting stations of a simple and robust construction.

This object has been achieved by an orienting station having a receiving device for the temporary receiving of the sheet metal parts, a driving device comprising several stationarily disposed drive units which each have an output, and a rod-type transmission arranged to connect the receiving device with the driving device and having several rods with fixed lengths and arranged between outputs of the drive units and the receiving device.

The orienting station according to the invention has a rod-type transmission which is arranged between a driving device and a receiving device. This transmits the movements of the driving device to and positions the receiving. The rod-type transmission is based on rods of a constant length whose low ends are moved in space. The rods are rigid, that is, their length cannot be adjusted and therefore have a high static and dynamic stiffness. In addition, they can be configured to be slender.

The driving device is spatially separated from the rods. The heat development of the driving device can therefore be kept away from the rods. No rotating parts or any type of drives are installed in the rods. They therefore have a simple construction.

Sufficient space exists for the drive units pertaining to the driving device. Standard drives, such as servo motors with spindle-type lifting gears, and a linear guide can be used. In this manner, the drive units are easily accessible. Maintenance and exchange can be carried out without any major problems.

The rod-type transmission and the driving device completely determine the spatial position of the receiving device. In this case, embodiments of the orienting station are contemplated which have two to six degrees of freedom. If individual degrees of freedom of the receiving device are blocked by an appropriate guidance, for example, by limiting the degrees of freedom in the joints by way of which the rods are connected to the drive unit and the receiving device, the only positioning of the remaining degrees of freedom must be carried out by drive units.

If six degrees of freedom are desirable, that is, the linear movement of the receiving device in three mutually rectangular directions in space and the rotation or swivelling about three mutually rectangular axes, six rods and six drive units are provided. Each rod is preferably connected directly with one drive unit respectively. If one degree of freedom is to be eliminated, for example, the movement in the vertical direction, one drive unit can also be eliminated and the corresponding rod can be fastened to a fixed linking point.

The joints which connect the rods with the receiving device and the driving device are preferably ball joints which permit swivelling in any direction.

In the preferred embodiment, adjacent rods are arranged at an acute angle with respect to one another, the angles preferably opening away from the receiving device. As a result, a spacesaving construction is obtained which, in addition, permits high positioning speeds. In this case, the arrangement of the rods can be such that no parallel pairs of rods are present. In addition, the driving units can be spaced from one another. The surface taken up by the drive units can be larger than the surface determined by the linking points of the rods on the receiving device.

The orienting station preferably interacts with a transfer system which links machining stations with one another with respect to the flow of parts. The machining stations preferably a press stations of a press system, the orienting station being arranged between the individual presses. A clear arrangement and a good utilization of the narrow space existing between the individual presses is obtained if the driving units are linear drives which preferably have a vertical or approximately vertical working direction.

It is particularly expedient for the drive units to be disposed in pairs on one support respectively and to be arranged on sides of the support which face way from one another. Twin-type drive units are therefore obtained for two rods respectively. In an orienting station which can be positioned in all directions in space and can swivel about all axes of rotation, three of such twin-type units are provided. The drive units can be mounted on the press tables. In this embodiment, the space between the bed plates is well utilized if one bedplate carries two twin-type units and the adjacent bedplate carries one twin-type unit.

While the linking points of the rods on the support device define a triangle, the linking points of the rods on the drive units are arranged to deviate therefrom, for example, according to aspects which permit a good utilization of space.

The drive units and their linear guides are preferably arranged at the corners or at the edges of a trapezoid. Four of the drive units are arranged at the corner points of the trapezoid. Two drive units are arranged on its longer edge. At the receiving device, the rods are then preferably linked in the hexagon or in the triangle.

Linear direct drives can be used as drive units. The drive units can be combined with brake units which brake taken-up positions. The receiving device can have exchangeable and/or swivellable supporting surfaces.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
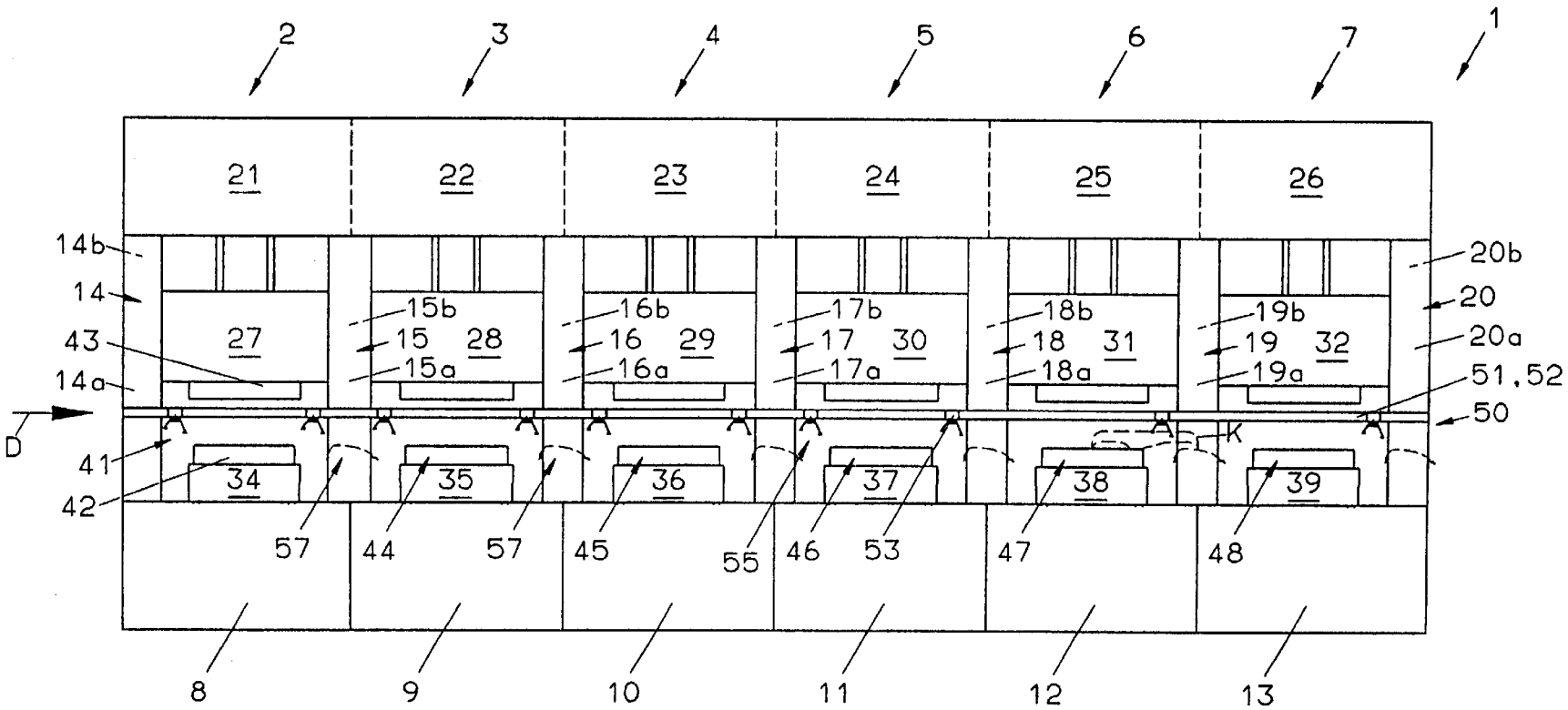
FIG. 1 is a schematic side view of a press system having a transfer system and orienting stations.

FIG. 1 illustrates a press system which is used for machining sheet metal parts. The press system 1 has several press stations 2, 3, 4, 5, 6, 7 which are arranged behind one another in the passage direction D and which each define a forming station for the sheet metal part to be formed. Each press station comprises a bedplate 8, 9, 10, 11, 12, 13 which, by way of suitable suspension and damping devices, rests on a foundation. Pairs of press stands 14, 15, 16, 17, 18, 19, 20 are set up on the bedplates 8, 9, 10, 11, 12, 13, and each consist of a press stand which, in FIG. 1, is situated in the front and is marked a, and a press stand which is hidden by press stand a and is marked b. The arrangement of the press stands is illustrated, for example, by press stands 15*a*, 15*b*, particularly in FIG. 2. The pairs of press stands 14 to 20 carry head pieces 21, 22, 23, 24, 25, 26. These carry one or several eccentric drives for slides 27, 28, 29, 30, 31, 32 which can be moved up and down.

In each press station 2 to 7, a sliding table 34, 35, 36, 37, 38, 39 is arranged on the respective bedplate 8, 9, 10, 11, 12, 13. Sliding table 34 can be moved laterally out of the press system 1 between adjacent press stands 14*a*, 15*a* and 15*a*, 16*a*, etc. The sliding table 34 supports a tool bottom part 42 pertaining to a tool 41. The pertaining tool top part 43 hangs on the slide 27. Correspondingly, tools 44, 45, 46, 47, 48 are arranged in the additional press stations 3, 4, 5, 6, 7 and each have a tool bottom part and a tool top part.

In order to carry out the parts transport through the entire press system 1, the press system 1 is provided with a transfer system 50. This transfer system 50 comprises guide rails 51, 52 which extend in the passage direction D through the press system 1. The guide rails 51, 52 are arranged parallel to one another in the proximity of the press stands 14*a*, 14*b* to 20*a*, 20*b*, so that the tools 41 to 48 have sufficient space between them. The guide rails 51, 52 can be lifted and lowered by lifting units.

The guide rails 51, 52 guide carriages 53 which, in pairs, guide a suction bridge 55 between one another. One suction bridge respectively is provided for inserting sheet metal parts in a tool 41 to 48, and one suction bridge is provided for the removal of a sheet metal part from the respective tool 41 to 48. As required, for inserting still unformed sheet metal parts (blanks) into the first press station 2, instead of the suction bridge, an insertion feeder may be provided.

Suitable driving devices move the carriages 53 on the guide rails 51, 52 in a targeted manner. Thereby, as a result of the superposition of the lifting and lowering movement of the guide rails 51, 52 and of the movement of the suction bridges 55 in the passage direction D, a transfer curve K is obtained. In FIG. 1, this transfer curve K is schematically outlined only between the press stations 6 and 7. The transfer step, measured in the passage direction D, is only half as short as the center distance between adjacent tools.

Figure 2:
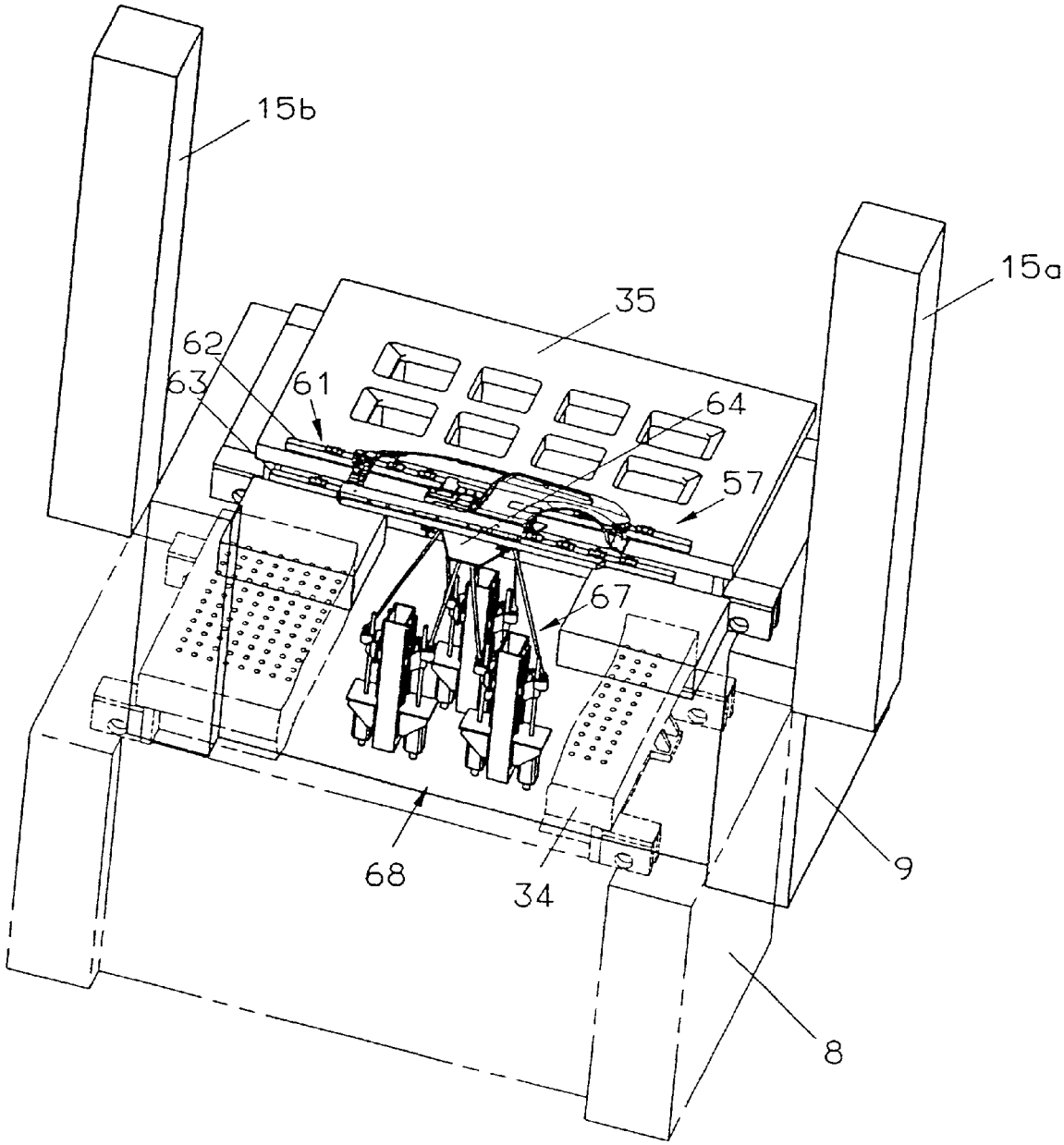
FIG. 2 is a schematic perspective cutout-type view of the press system according to FIG. 1.
Figure 3:
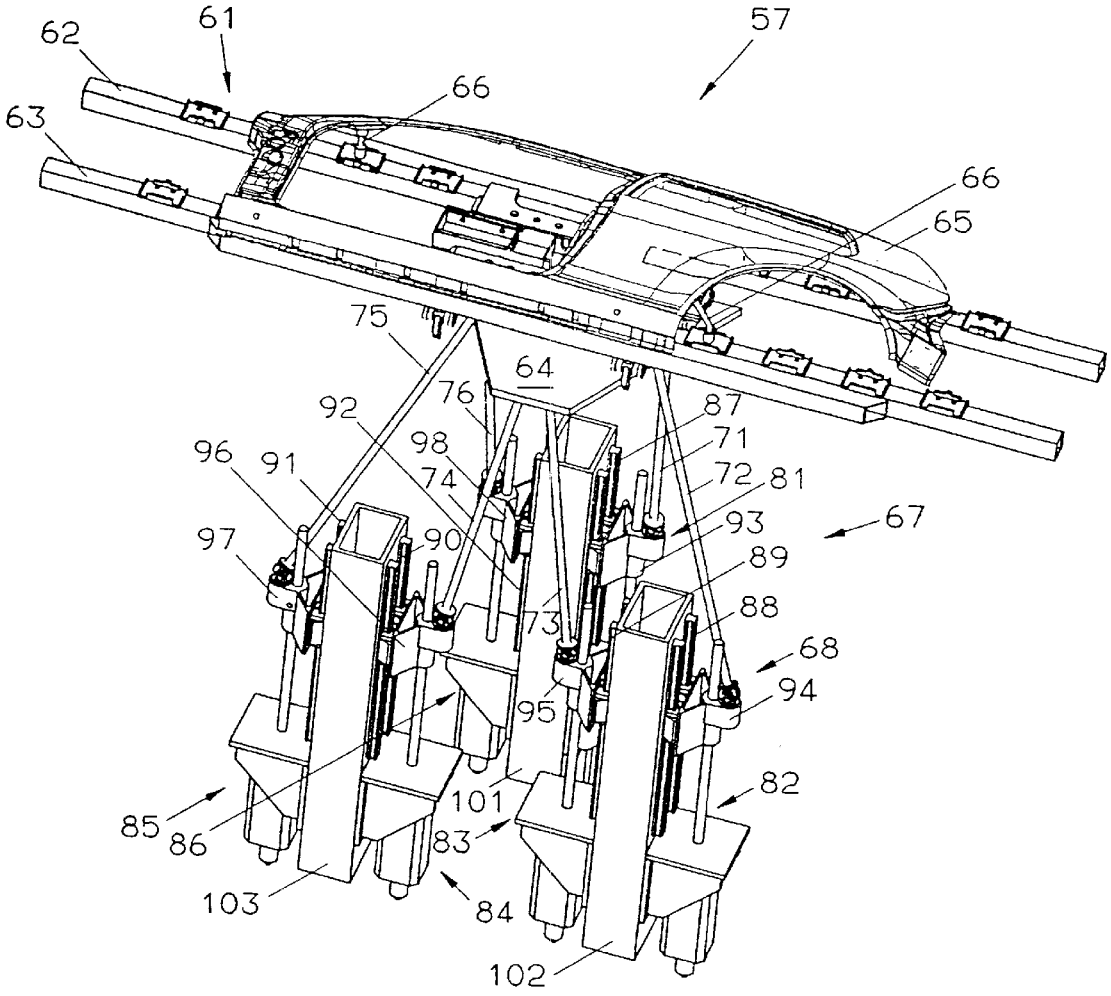
FIG. 3 is a perspective view of an orienting station of the press system according to FIGS. 1 and 2.

Between the tools 41, 44; 44, 45; 45, 46; 46, 47 and 47, 48, orienting stations 57 are arranged which are used as intermediate depositing devices and are better illustrated in FIGS. 2 and 3. The orienting stations 57 each have essentially the same constructions. The orienting station 57 arranged between the press stations 2 and 3, in the following, will be described in a manner which is representative of all orienting stations.

Orienting station 57 has the purpose of providing the workpiece with a new orientation on its moving path from tool to tool. The object of the transfer system 50 can then be limited to transferring the workpiece, that is, to carrying out a purely three-dimensional movement. The suction bridge 55, for example, can be constructed to be non-rotatable. The orienting station 57 arranged below the transfer system 50 has a receiving device 61 on its top side which comprises two transverse rails 62, 62 held in parallel to one another. A support 64 holds these rails to be swivellable away from one another and toward one another. On their top side, the transverse rails 62, 63 can be provided with receiving devices 66 for an adaptation to the sheet metal part contour. This is illustrated particularly in FIG. 3. A sheet metal part 65 disposed on the receiving device 57, for example, a passenger car side panel, is schematically illustrated in FIGS. 2 and 3.

The transverse rails 62, 63 can be swivelled toward and away from one another about swivelling axes oriented parallel to the transverse axes 62, 63 and in parallel to one another. In addition, as required, the transverse rails 62, 63 can be detachably held on the support 64. The receiving elements 66 can preferably be detached from the transverse rails 62, 63.

The positioning of the sheet metal part 65 takes place by a controlled positioning of the support 64. For this purpose, a rod-type transmission 67 is used which establishes the connection to a driving device 68. The rod-type transmission comprises a total of six rods 71, 72, 73, 74, 75, 76 which have a rigid construction. In addition, they may each have the same length. As required, however, they may also have individually different lengths. At their respective upper end, the rods 71 to 76 are each bordered by a cardan joint or ball at the support 64.

The rods 71 to 76 are each disposed in pairs in the direct vicinity on the support so that the bearing points together approximately define a triangle, preferably an equilateral triangle. Adjacent rods 71, 72; 72, 73; 73, 74; 74, 75; 75, 76 and 76, 71, together, enclose a more or less acute angle. Rods 71, 76 are exceptions and, as required, may be arranged parallel to one another, at least when the support is not tilted horizontally or about a longitudinal axis which is parallel to the passage direction D.

The driving device 68 comprises a total of six drive units 81, 82, 83, 84, 85, 86 which can each be controlled separately. The drive units 81 to 86 are linear drive units, each having a servo motor. The servo motors are computer controlled. By way of a spindle-type lifting gear and a linear guide 87, 88, 89, 90, 91, 92, the rotating movement of the respective servo motor is converted into a linear movement of a carriage 93, 94, 95, 96, 97, 98. Each carriage 93 to 98 is connected with a rod 71 to 76 in an articulated manner by way of a cardan joint or a ball joint. As a result, one drive unit 81 to 86 is assigned to each rod 71 to 76.

The drive units 81 to 86 are each carried in pairs by a support 101, 102, 103. These supports are formed, for example, by a vertically arranged box-section support. This support arrangement permits a largely unhindered arrangement of the rods 71 to 76 of the rod-type transmission 67, and simultaneously the construction of relatively long guiding paths and thus vertical lifts of the carriages 93, 94, 95, 96, 97 and 98. This applies particularly if the box-section supports 101, 102, 103 are arranged parallel to one another in the top view in the triangle and the drive units 81 to 86 are each arranged in pairs on flanks of the support elements 101, 102, 103 which point away from one another. In this case, the support elements 102, 103 are fastened, for example, on the bedplate 8. The support element 101 is disposed on the bedplate 9.

If the carriages 93 to 98 are adjusted at the same level, the joints for carrying the rod ends of the rods 71 to 76 define a trapezoid. As a result, the drive units 82, 83, 84, 85 are virtually disposed on a common line. Their guiding directions are parallel to one another. Likewise, the two drive units 81, 86 are situated on a common second line parallel to the first line. The relatively narrow space between the bedplates 8, 9 is therefore well utilized. The drive units 81 to 86 are stationary and can be standard drives. The drives arranged outside the rods 71 to 76 are easily accessible. Likewise, the linear guide 87 to 92 provided in each case on the support elements 101, 102, 103 can be constructed to be stationary and therefore robust.

In operation of the above-described press system 1, The slides 27 to 32 of the press system 1 are moved synchronously up and down by a main press drive. Each time the tools 41 to 48 open up, the transfer system 50 moves the suction bridges 53 into the tools in order to introduce sheet metal parts and/or remove them. In this case, the transfer system 50 also services every intermediate depositing device or orienting station 57 in that first, by way of a suction bridge, a sheet metal part 65 is removed and, immediately thereafter, a next sheet metal part 65 is again placed on the receiving device 61. The control device controls the servo motors of the drive units 81 to 86 such that the receiving device 61 for receiving the sheet metal part 65 is first situated in the spatial position in which the sheet metal part is delivered by the transfer system 50.

During the sheet metal part transfer, the receiving device 61 is essentially inoperative. As an alternative, the driving device 68 can be controlled such that, during the sheet metal part transfer, i.e., during the placing of the sheet metal part 65 onto the receiving elements 66, the receiving device, for a short time, carries out a movement which corresponds to the movement of the suction bridge 55. As required, correction movements can also be carried out. When the sheet metal part 65 is lying on the receiving device 61, the suction bridge 55 releases the sheet metal part 65, separates from it and moves into a parking position which is spaced away from the orienting station 57. The orienting station 57 optionally facilitates the return movement of the suction bridges by a vertical downward movement of the sheet metal part 65.

The orienting station 57 has now taken over the sheet metal part 65 and positions it during the working stroke of the press in a fetch position, in which the sheet metal part 65 can have a changed orientation and/or positioning, that is, a changed spatial position. In this case, in the embodiment of the orienting station 57 illustrated in FIGS. 2 and 3, all linear movements, that is, longitudinally (in the passage direction D), transversely thereto, as well as vertically (lifting and lowering) can be carried out. In addition, the sheet metal part 65 can be swivelled about the longitudinal axis (parts passage direction D) about a horizontal transverse axis as well as about a vertical axis. This takes place by the targeted controlling of the drive units 81 to 86 by the control device.

If the sheet metal part 65 is to be transported farther, it fetches the next following suction bridge 55. The suction bridge 55, by way of its suction devices, is first placed on the sheet metal part 65 which is held still by the orienting station 57 in the corresponding orientation and position. Alternatively, the orienting station 57 can be controlled to carry out a movement along a limited path section corresponding to the movement of the suction bridge.

In alternative embodiments, if fewer positioning possibilities are desired, individual drive units can be eliminated. Only two, three, four a five drive units may, for example, be sufficient, depending on how many degrees of freedom are required by the positioning movement of the receiving device 61. As required, instead of the ball or cardan joints, other joints can also be used.

An orienting station 57, which is provided particularly for press systems 1, has a receiving device 61 which is carried by a rod-type transmission 67. This rod-type transmission 67 is supported on drive units 81, 82, 83, 84, 85, 86 of a driving device 68. The drive units 81 to 86 are disposed in a stationary manner. The rods 71 to 76 of the rod-type transmission 67 are rigid and their length cannot be changed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An orienting station for sheet metal parts to be transported through a succession of machining stations, comprising:

a receiving device for temporarily receiving the sheet metal parts, a driving device comprising several stationarily disposed drive units which each have an output, and a rod-type transmission being arranged to operatively connect the receiving device with the driving device and having a plurality of rods with fixed lengths swivellably arranged between outputs of the drive units and the receiving device.

2. The orienting station according to claim 1, wherein the rod-type transmission and the driving device completely define the position of the receiving device.

3. The orienting station according to claim 1, wherein the rods correspond in number of degrees of freedom of the movement of the receiving, and the drive units correspond in number to the number of the rods with one drive unit being assigned to each rod.

4. The orienting station according to claim 1, wherein adjacent rods, in pairs, enclose with one another an acute angle, with the angles opening away from the receiving device.

5. The orienting station according to claim 1, wherein joints connect the rods with the receiving device, at least two of the rods being arranged to form an approximately triangular outline.

6. The orienting station according to claim 1, wherein joints connect the rods with the drive units, which rods are arranged to form an approximately hexagonal outline with the joints defining a trapezoid shape along a plane.

7. The orienting station according to claim 1, wherein the drive units are linear drives controllable by a control device, so as to move the output thereof into defined positions.

8. The orienting station according to claim 7, wherein the linear drives include a parallel guiding direction which is substantially vertically oriented.

9. The orienting station according to claim 7, wherein the linear drives are configured as direct drives.

10. The orienting station according to claim 1, wherein the drive units are arranged in spaced pairs on sides of a respective support.

11. The orienting stations according to claim 10, wherein the driving device comprises six drive units which are fastened on three supports which are arranged in a triangle configuration.

12. The orienting station according to claim 10, wherein the machining stations comprise press stations of a press system, and the supports are fastened on bedplates.

13. The orienting station according to claim 1, wherein the driving device and the rod-type transmission are arranged below the receiving device.

14. The orienting station according to claim 1, wherein the receiving device has adjustable supporting surface devices.

15. A press system having several press stations which each comprise a bedplate, press stands, a head piece, a slide and a sliding table, the system further comprising:

a transfer device configured to transport parts through the press system, and at least one orienting station between two press stations and between the press stands the at least orienting station having:

a receiving device for the temporary receiving of the sheet metal parts, a driving device comprising several stationarily disposed drive units which each have an output, and a rod-type transmission arranged to connect the receiving device with the driving device and having several rods with fixed lengths swivellably arranged between outputs of the drive units and the receiving device.

16. The press system according to claim 15, wherein the transfer device is arranged to transport the parts on a two-dimensional transfer curve with orientation of the sheet metal parts occurring solely in the at least one orienting station.

* * * * *